US009518433B2

(12) United States Patent
Naumann et al.

(10) Patent No.: US 9,518,433 B2
(45) Date of Patent: Dec. 13, 2016

(54) TUBEWIRE INJECTION BUCKLING MITIGATION

(71) Applicant: Baker Hughes Incorporated, Houston, TX (US)

(72) Inventors: Andre J. Naumann, Calgary (CA); Mitchell Lambert, Calgary (CA)

(73) Assignee: BAKER HUGHES INCORPORATED, Houston, TX (US)

( * ) Notice: Subject to any disclaimer, the term of this patent is extended or adjusted under 35 U.S.C. 154(b) by 423 days.

(21) Appl. No.: 14/080,911

(22) Filed: Nov. 15, 2013

(65) Prior Publication Data

US 2015/0136427 A1 May 21, 2015

(51) Int. Cl.
*E21B 19/22* (2006.01)
*E21B 17/20* (2006.01)

(52) U.S. Cl.
CPC ..... *E21B 19/22* (2013.01); *E21B 17/20* (2013.01); *E21B 17/206* (2013.01)

(58) Field of Classification Search
CPC ..... E21B 17/206
USPC ..... 254/134 SFT, 134.3 R, 134.4
See application file for complete search history.

(56) References Cited

U.S. PATENT DOCUMENTS

| | | | | |
|---|---|---|---|---|
| 4,640,576 | A * | 2/1987 | Eastwood | G02B 6/4485 226/7 |
| 5,169,126 | A * | 12/1992 | Reeve | G02B 6/4438 254/134.3 R |
| 5,503,370 | A | 4/1996 | Newman et al. | |
| 5,599,004 | A | 2/1997 | Newman et al. | |
| 5,946,788 | A | 9/1999 | Griffioen et al. | |
| 6,367,557 | B1 | 4/2002 | Rosine et al. | |
| 2005/0045343 | A1 | 3/2005 | Bixenman et al. | |
| 2010/0096124 | A1 | 4/2010 | Naumann | |

* cited by examiner

*Primary Examiner* — Jennifer H Gay
*Assistant Examiner* — Steven MacDonald
(74) *Attorney, Agent, or Firm* — Shawn Hunter

(57) ABSTRACT

A tubewire buckling mitigation assembly for use with injection of tubewire into coiled tubing. The mitigation assembly includes a passageway having a small diameter passage, an intermediate diameter section and first and second tapered transition sections.

13 Claims, 3 Drawing Sheets

TUBEWIRE INJECTION BUCKLING MITIGATION

BACKGROUND OF THE INVENTION

1. Field of the Invention

The invention relates generally to devices and methods used to dispose tubewire into a radially surrounding tubing string.

2. Description of the Related Art

Coiled tubing has become a popular means for running a bottom hole assembly ("BHA") or other tools into a subterranean wellbore. In most cases, it is desirable to be able to transmit electrical power down to the BHA or other tools as well as to permit control signals or sensed data to be transmitted between the surface and the downhole tools. Conventionally, this is done by disposing wireline into the coiled tubing. Wireline is a braided steel cable with layers of armor with conductors inside.

Use of wireline can be problematic. Wireline is prone to damage from acidic fluids in some instances. The slack in wireline must be adjusted over time, which requires time and money.

Tubewire is an alternative to wireline and has many advantages over wireline. Tubewire can be disposed inside coiled tubing to provide electrical power and a signal path from the surface to various downhole tools attached to the end of the coiled tubing. Tubewire is a tube that contains an insulated cable that is used to provide electrical power and/or data to the bottom hole assembly or to transmit data from the BHA to the surface. Tubewire is substantially inflexible relative to its wireline. Tubewire is available commercially from manufacturers such as Draka Cableteq of North Dighton, Mass.

Tubewire can be disposed into coiled tubing at the surface. Systems and methods for injecting and retrieving tubewire into and out of coiled tubing are discussed in U.S. Pat. No. 7,845,419 by Naumann, which is incorporated herein by reference in its entirety. While the coiled tubing is spooled up on a reel at surface, the tubewire is placed into the coiled tubing by pumping fluid through the coiled tubing at high flow rates while an injector is used to feed the tubewire into the coiled tubing by applying a pushing force. The inventors have determined that, occasionally, the tubewire can get stuck or stop moving during injection. As a result, the full motive force of the injector is applied to stationary tubewire, causing the tubewire to buckle and be permanently damaged. When tubewire buckles, it tends to take on a helical shape just prior to failure. The inventors have determined that coiled tubing has a large inside diameter ("ID") relative to the outside diameter ("OD") of the tubewire. Therefore, a relatively small axial force can cause the tubewire to buckle, plastically yield and fail inside the coiled tubing. The tubewire injector can easily generate the required axial force.

U.S. Pat. No. 7,845,419 by Naumann discussed the use of a flexible wand to mitigate buckling of tubewire during injection.

SUMMARY OF THE INVENTION

The present invention provides devices and methods that can reduce or eliminate the potential for buckling to occur during tubewire injection. An exemplary tubewire injection system is described which includes an injector having a drive mechanism adapted to apply an axial pushing force to the tubewire in order to inject the tubewire into the coiled tubing. In certain embodiments, the injector can also apply an axial pulling force on the tubewire in order to retrieve the tubewire. Also in certain embodiments, the injection system includes a pumping mechanism adapted to pump fluids through the coiled tubing while axial force is being applied to the tubewire. Preferably, the tubewire injector includes a drive mechanism that will drive the tubewire at a preselected speed or rate so that tension is maintained on the tubewire during injection and retrieval. The tubewire injection system can further include a control system to regulate injector forces, such as spool speed, drive mechanism speed and fluid pressure, at levels desirable for injection or removal of the tubewire.

The tubewire injection system of the present invention includes a buckling mitigation assembly. In described embodiments, the buckling mitigation assembly features a first small diameter passage for the tubewire to pass through as it exits the injector. A first tapered transition section is provided between the small diameter passage and an intermediate diameter passage. A second tapered transition section is provided between the intermediate diameter passage and the opening of the coiled tubing into which the tubewire is being injected. In certain embodiments, the second tapered transition section will be connected to a large diameter passage whose interior diameter approximates the interior diameter of the coiled tubing. The large diameter passage is then coupled to the coiled tubing.

In particular embodiments, the intermediate diameter tubing section has an inner diameter that is from about 0.5 inches to about 2.0 inches. Also in particular embodiments, the intermediate diameter tubing section has an axial length of from about less than one foot to about 20 feet.

The buckling mitigation assembly can be incorporated within sections of treating iron which extend between the injector and the coiled tubing. In operation, the intermediate diameter tubing section together with the tapered transition sections provide reduced diameter pathways through which the tubewire must pass and which provide lateral forces that counter buckling.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

The term "tubewire", as used herein, refers to a tube which may or may not encapsulate a conductor or other communication means, such as, for example, the tubewire manufactured by Draka Cableteq of North Dighton, Mass. Tubewire for example, might consist of a ⅛" outer diameter by 0.023" wall of stainless steel or Incoloy 825 tube containing 16-18 gauge stranded copper wire covered by Halar™ or Teflon™ insulator. In this example, the insulator is tight against the tube and the wire. In the alternative, the tubewire may encapsulate one or more fiber optic cables or a mixture of wire(s) and fiber optic cable(s). The tubewire may consist of multiple tubes and may be concentric or may be coated on the outside with plastic or rubber.

Figure 1:
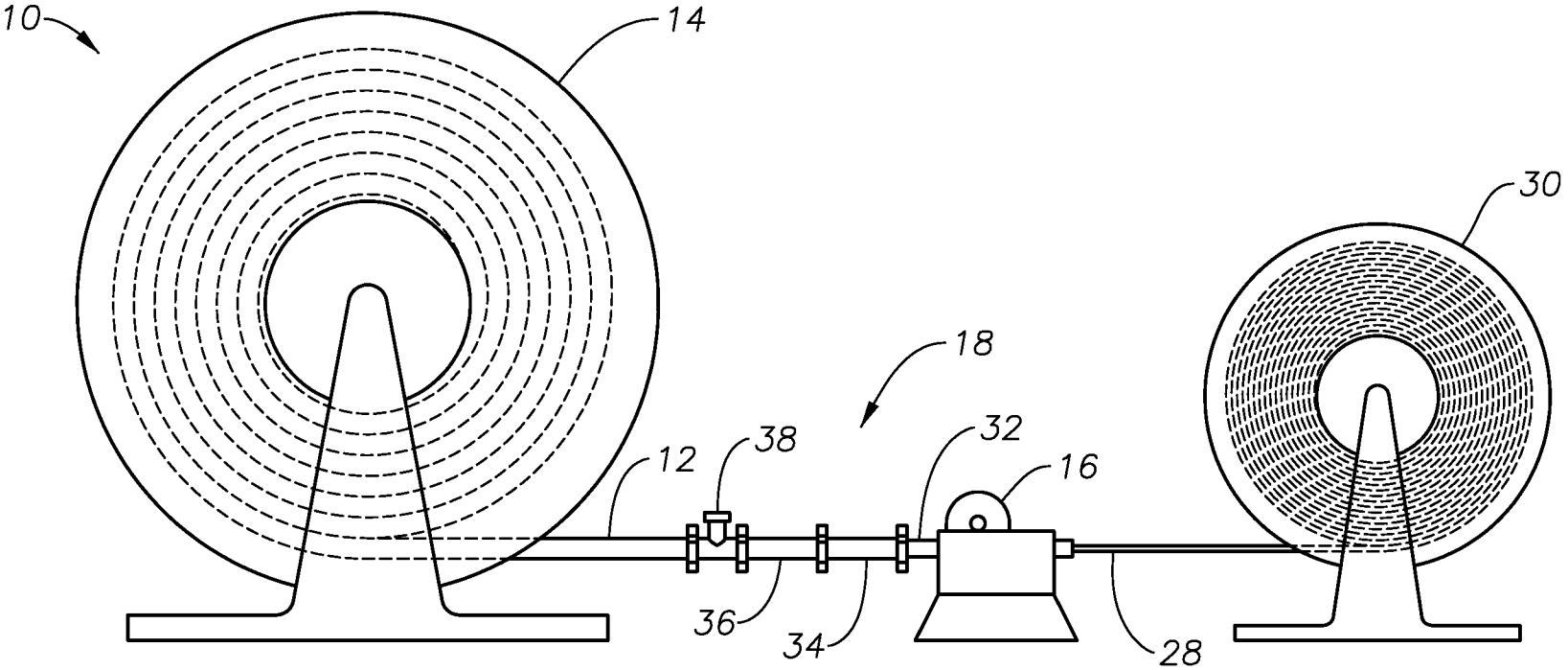
FIG. 1 is a side view of an exemplary tubewire injection system which includes a buckling mitigation assembly in accordance with the present invention.

FIG. 1 illustrates an exemplary tubewire injection system 10. Coiled tubing 12 is shown wrapped onto a coiled tubing reel or work spool 14. A specialized injector 16 is operably associated with the whip end of the coiled tubing 12 via a tubewire buckling mitigation assembly 18 which will be described in detail later in this disclosure. In this described embodiment, the injector 26 is hydraulically driven and controlled. However, it could be electrically driven and controlled or some combination of the two.

Tubewire 28 is wrapped onto another spool 30 and can be fed from spool 30 into injector 26 and then into coiled tubing 12 through the buckling mitigation assembly. Spool 30 may also be hydraulically or electrically controlled and driven at a selected speed.

As described in U.S. Pat. No. 7,845,419 [hereinafter, "the '419 patent], a pump (not shown) is preferably used to apply fluid pressure to help inject the tubewire 28 into the coiled tubing 12 or to retrieve tubewire 28 from within the coiled tubing 12. The '419 patent also describes a control system that is in communication with spool 30, injector 16, and the fluid pump via bi-directional communication links in order to monitor and regulate the injector forces. The '419 patent also describes an exemplary drive mechanism used by the injector 16.

Figure 2:
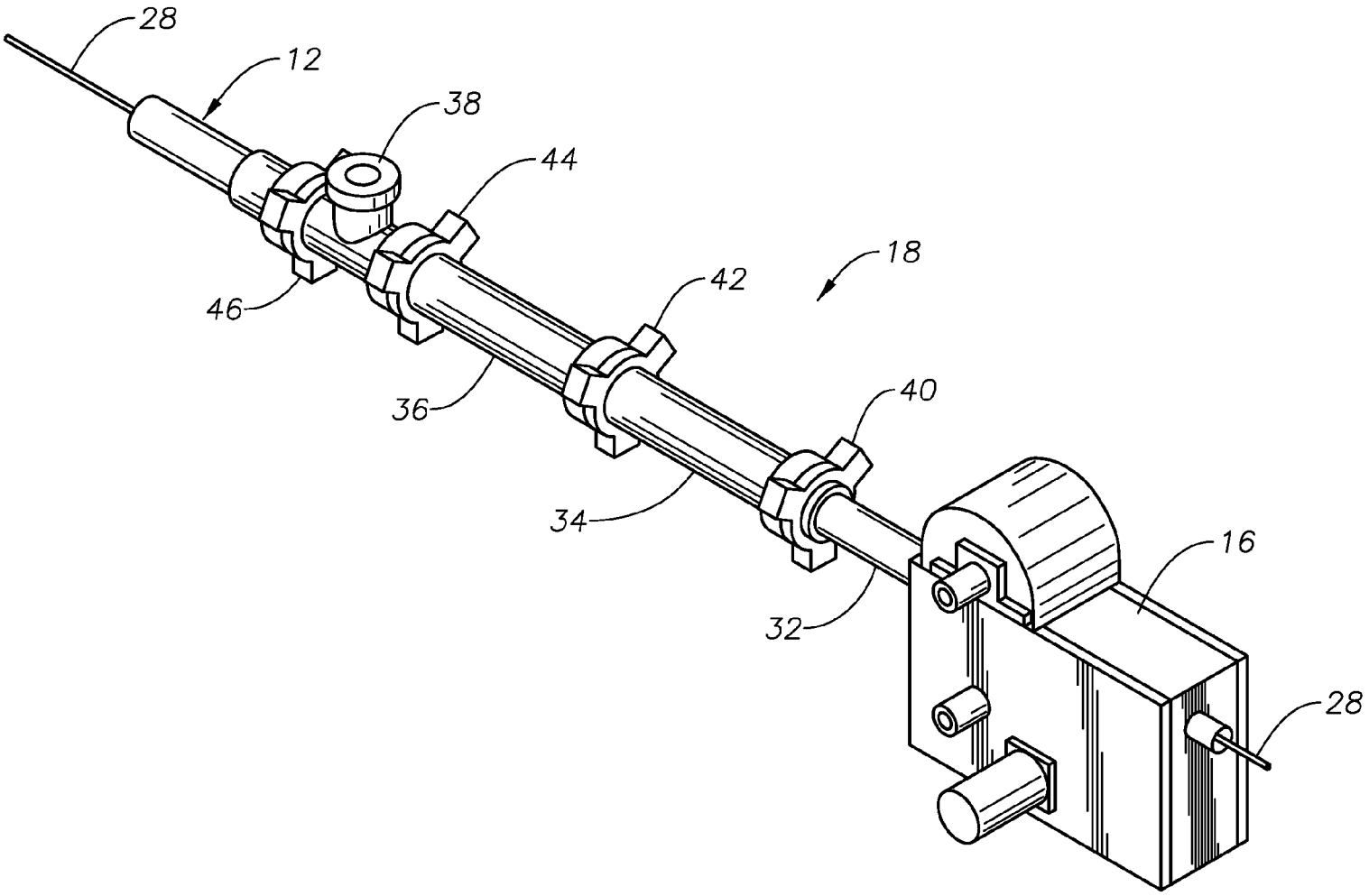
FIG. 2 is an isometric view of portions of an exemplary buckling mitigation assembly in accordance with the present invention.

Referring primarily to FIG. 2, it can be seen that the exemplary tubewire buckling mitigation assembly 18 is embodied within a tubular segment 32 and two sections of treating iron 34, 36 as well as a treating iron tee 38. Collar 40 interconnects the tubular segment 32 with the first section 34 of treating iron. Collar 42 interconnects the first and second sections 34, 36 of treating iron. A collar 44 interconnects the second treating iron section 36 with the treating iron tee 38. A further collar 46 secures the whip end of the coiled tubing 12 to the treating iron tee 38.

Figure 3:
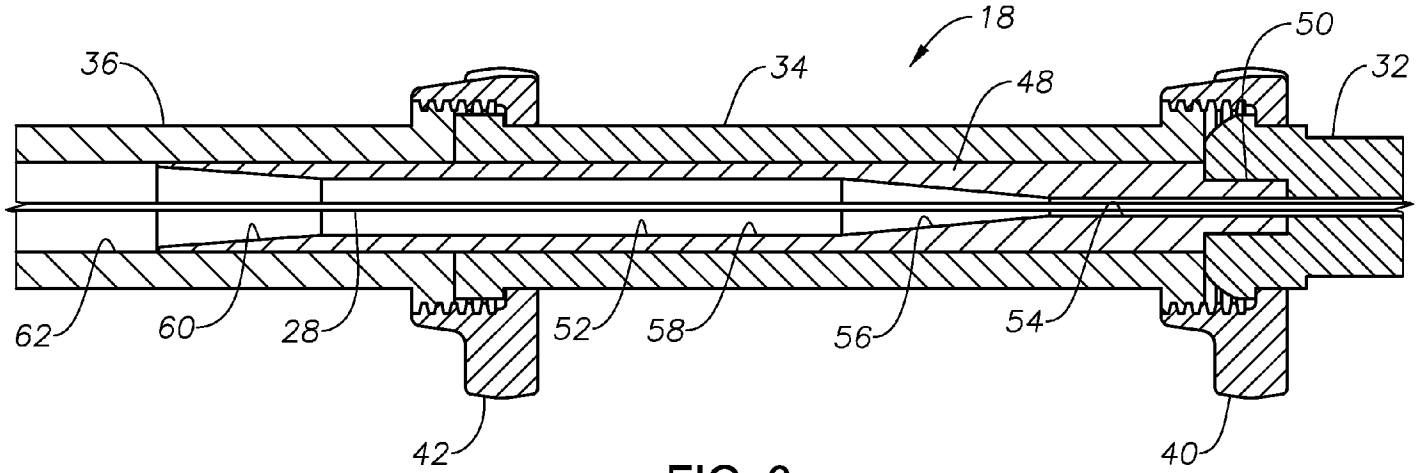
FIG. 3 is an enlarged, side cross-sectional view of portions of the buckling mitigation assembly in accordance with the present invention.

FIG. 3 is a side cross-section depicting internal portions of the tubewire buckling mitigation assembly 18. An insert 48 is disposed within the first and second sections of treating iron 34, 36 and is secured at its axial end 50 to the tubular segment 32. The insert 48 defines a central axial passageway 52 which will receive the tubewire 28 from the injector 16. As will be described, the interior profile of the insert 48 presents portions having different, gradually expanding diameters.

Figure 4:
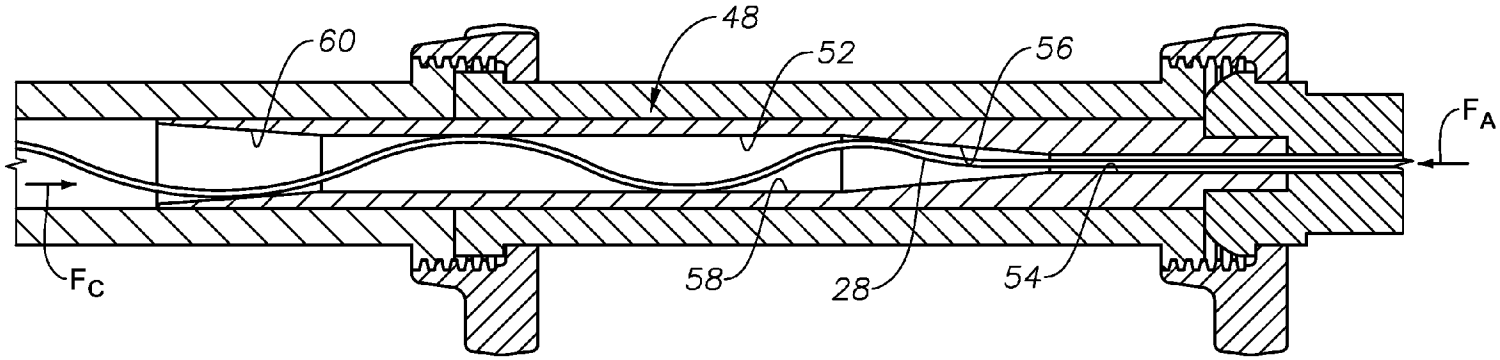
FIG. 4 is a side, cross-sectional view of portions of the buckling mitigation assembly with tubewire being injected therethrough.

In FIG. 3, tubewire 28 is depicted along an intended (straight) path rather than an actual one. FIG. 4, however, illustrates the tubewire 28 having been subjected to actual injection resistance forces which cause it to buckle helically.

The interior profile of the insert 48 will be described with reference to both FIGS. 3 and 4. The central axial passageway 52 of the insert 48 includes a first, small diameter passage 54 into which the tubewire 28 is disposed from the injector 16. The small diameter passage 54 presents an interior diameter that is only slightly larger than the outer diameter of the tubewire 28 so that the tubewire 28 is essentially unable to be buckled within the small diameter passage 54. Adjacent the small diameter passage 54 is a first tapered transition section 56. The first tapered transition section 56 interconnects the small diameter passage 54 with an intermediate diameter section 58. The intermediate diameter section 58 presents an interior diameter that is larger than the interior diameter of the small diameter passage 54 but smaller than the interior diameter of the coiled tubing 12 into which the tubewire 28 is being injected. The interior diameter of the intermediate diameter section 58 is large enough so that the tubewire 28 is able to buckle within to a limited degree. However, the interior diameter of the intermediate diameter section 58 is not large enough to permit helical buckling to a degree that would cause the tubewire 28 to rupture or fail. A second tapered transition section 60 lies adjacent the intermediate diameter section 58 and transitions to the central axial passage 62 within the treating iron section 36, whose diameter approximates the interior diameter of the coiled tubing 12 into which the tubewire 28 is being injected. The inventors have determined that the presence of an untapered intermediate diameter section 58 is preferred because it will allow the development of axial friction forces to resist the injector forces.

In preferred embodiments, the intermediate diameter section 58 has a length that is from less than one foot to about 20 feet. In more preferred embodiments, the length is from about 5 feet to about 20 feet. In particularly preferred embodiments, the intermediate diameter section 58 has a length of about 10 feet and provides an interior diameter of about 1.05 inches.

According to further preferred embodiments, the first tapered transition section 56 has a length of about 24 inches. The second tapered transition section 60 has a preferred length of about 12 inches. However, it should be understood that these lengths are exemplary only rather than limiting. Also, it should be understood that the preferred or optimal lengths may change as other dimensions of the tubewire buckling mitigation assembly 18 are changed. For example, the preferred length of the first tapered transition section 56 might be different if the intermediate diameter section 58 had a different internal diameter.

It is noted that the angle of the tapers used for the first and second tapered transition sections 56, 60 is preferably very gentle. In preferred embodiments, the angle of the tapers (as measured from the central axis) for the sections 56, 60 is from about 1 degree to about 5 degrees. In particularly preferred embodiments, the angle of the tapers is approximately 1 degree.

According to exemplary methods of operation in accordance with the present invention, tubewire 28 is injected by the injector 16 through the buckling mitigation assembly 18 and into the coiled tubing 12. At the same time, fluid (normally water) is pumped through the treating iron tee 38 and into the coiled tubing 12. It is this fluid movement which "drags" the tubewire 28 along and into the coiled tubing 12. Significant pressure exists within the treating iron sections 34, 36 to allow for the fluid flow rates necessary to move the tubewire 28. When the tubewire 28 stops moving into the coiled tubing 12 for any reason, a force (Fc) will arise which acts along the tubewire 28 in opposition to the injector force (Fa). This opposing force (Fc) will cause the tubewire 28 to buckle helically, as depicted in FIG. 4. The tubewire 28 begins to helix inside of the first and second tapered transition sections 56, 60 and the intermediate diameter passage 58. The tapered transition sections 56, 60 at both ends of the intermediate diameter section 58 remove any abrupt changes to the internal diameter of the passageway surrounding the tubewire 28, thereby minimizing any stress risers and thus removing the likelihood of the tubewire 28 buckling to failure in transition areas. As the tubewire 28 buckles in a helical manner, it contacts the interior diameter of the intermediate diameter section 58 with sufficient force to develop significant friction forces. These friction forces act to resist the input injector force Fa. The intermediate diameter section 58 is designed in such a manner as to maximize the friction and, thus, the resisting force. In effect, there is a small load in the tubewire 28 created within the second tapered transition section 60. This small load causes significant helixing of the tubewire 28 within the intermediate diameter section 58, and this helixing results in high friction forces. These friction forces hold back the injector force Fa proximate the small diameter passage 54. The inventors have found that, in practice, the tubewire 28 is nicely supported everywhere with tapered portions and reduced diameter interior portions (58) that are sized to prevent catastrophic failure due to helical buckling.

The tapered transition sections 56, 60 and intermediate diameter section 58 are described herein as being defined within an insert 48 that is located within sections of treating iron 34, 36. However, it should be understood that this specific construction is exemplary only and that the described interior profile of the buckling mitigation assembly 18 can be constructed in a number of other ways.

Those of skill in the art will recognize that numerous modifications and changes may be made to the exemplary designs and embodiments described herein and that the invention is limited only by the claims that follow and any equivalents thereof.

What is claimed is:

1. A tubewire injection system for injecting tubewire into coiled tubing, the system comprising:

a tubewire injector having a drive mechanism to apply an axial pushing force to inject the tubewire;

coiled tubing having an inner diameter and presenting an open whip end into which the tubewire is injected; and a tubewire buckling mitigation assembly located between the injector and the coiled tubing and comprising a passageway which receives the tubewire from the injector, the passageway providing:

a small diameter passage having an interior diameter that inhibits buckling of the tubewire;

an intermediate diameter section having an interior diameter that permits limited buckling of the tubewire; and a first tapered transition section disposed between the small diameter passage and the intermediate diameter section; and a second tapered transition section disposed between the intermediate diameter section and the open whip end, the second tapered transition section providing a tapered transition which opens from the intermediate diameter section to the open whip end.

2. The tubewire injection system of claim 1 wherein the intermediate diameter section presents an interior diameter that is sized to inhibit bucking of the tubewire.

3. The tubewire injection system of claim 1 wherein the intermediate diameter section has a length that generates axial resistance friction force with the tubewire to resist injection forces.

4. The tubewire injection system of claim 1 wherein the intermediate diameter section has a length that is from about 5 feet to about 20 feet.

5. The tubewire injection system of claim 4 wherein the intermediate diameter section has a length that is about 10 feet.

6. The tubewire injection system of claim 1 wherein the first tapered transition section has an angle of taper of about one degree.

7. The tubewire injection system of claim 1 wherein the second tapered transition section has an angle of taper of about one degree.

8. A tubewire injection system for use with a tubewire injector having a drive mechanism to apply an axial pushing force to inject tubewire into coiled tubing, the system comprising:

coiled tubing having an inner diameter and presenting an open whip end into which the tubewire is injected; and a tubewire buckling mitigation assembly located between the injector and the coiled tubing and comprising a passageway which receives the tubewire from the injector, the passageway providing:

a small diameter passage having an interior diameter that inhibits buckling of the tubewire;

an intermediate diameter section having an interior diameter that permits limited buckling of the tubewire;

a first tapered transition section disposed between the small diameter passage and the intermediate diameter section; and a second tapered transition section disposed between the intermediate diameter section and the open whip end, the second tapered transition section providing a tapered transition which opens from the intermediate diameter section to the open whip end.

9. The tubewire injection system of claim 8 wherein the intermediate diameter section presents an interior diameter that is sized to inhibit bucking of the tubewire.

10. The tubewire injection system of claim 8 wherein the intermediate diameter section has a length that generates axial resistance friction force with the tubewire to resist injection forces.

11. The tubewire injection system of claim 8 wherein the intermediate diameter section has a length that is from about 5 feet to about 20 feet.

12. The tubewire injection system of claim 11 wherein the intermediate diameter section has a length that is about 10 feet.

13. The tubewire injection system of claim 8 wherein the first and second tapered transition sections have an angle of taper from about one degree to about five degrees.

* * * * *